US005441069A

United States Patent [19]

Moss

[11] Patent Number: 5,441,069

[45] Date of Patent: Aug. 15, 1995

[54] TENSION FABRIC STRUCTURE WITH ARCHES

[75] Inventor: C. William Moss, Scottsdale, Ariz.

[73] Assignee: Bill Moss, Inc., Scottsdale, Ariz.

[21] Appl. No.: 192,968

[22] Filed: Feb. 7, 1994

[51] Int. Cl.[6] ..... E04H 15/36

[52] U.S. Cl. ..... 135/124; 135/135; 135/115

[58] Field of Search ..... 135/124, 135, 137, 138, 135/128, 115, 125, 133, 140, 114, 119, 136

[56] References Cited

U.S. PATENT DOCUMENTS 3,724,473 4/1973 Moss .
4,201,237 5/1980 Watts et al. ..... 135/135 X
4,644,706 2/1987 Stafford et al. .
4,880,024 11/1989 Brell .
4,886,084 12/1989 Lawrence et al. ..... 135/124 X
4,945,936 8/1990 Surrendi .
4,966,178 10/1990 Eichhorn .
4,981,387 1/1991 Younjae ..... 135/135 X
5,345,962 9/1994 Moss ..... 135/124

*Primary Examiner*—Lanna Mai
*Attorney, Agent, or Firm*—Marshall & Melhorn

[57] ABSTRACT

A lightweight fabric structure forming a pavilion type tent structure having fabric arches stretching from corner to corner, which define the periphery of the structure. Curved corner poles and a center hub with an extended rod are used to maintain tension and hold the arches upright. A base is provided at each corner to secure the corner poles and the fabric. The corner poles are extended from the base to tighten the fabric and achieve the desired tension needed to provide a smooth and wrinkle free fabric structure.

10 Claims, 2 Drawing Sheets

TENSION FABRIC STRUCTURE WITH ARCHES

BACKGROUND OF THE INVENTION

1. Field of the Invention

The invention relates generally to a lightweight tension structure, and in particular, to a pavilion-type tent structure having a plurality of corner poles, a fabric membrane with arches formed in the peripheral edge of the fabric membrane, and a base for securing the corner poles and the corners of the fabric membrane to a support surface such that the corner poles are extended to place the fabric in the desired tension for the structure.

2. Summary of the Related Art

Fabric structures and enclosures are used in a variety of applications. Large fabric domes cover outdoor arenas, shopping malls, swimming pools, tennis courts and other locations having a need for a customized shelter. Specially designed fabric structures may be temporarily or permanently used for fairs, meeting halls, pavilions, barracks, and other similar applications. Smaller tents provide camping and residential shelters.

Fabric structures are also used extensively for commercial awnings and canopie's to provide both shelter and promotional benefits to a business entity. In addition to the more traditional uses noted above, fabric structures may also be used for sculptures and other more artistic purposes.

In fabric structures, the proper tension must be maintained on the fabric to accommodate the intended application of such fabric structure. A number of different support structures and tensioning means have been developed to maintain the desired tension in a fabric structure. Most of the smaller or mid-sized fabric structures utilize a center support means with anchored guide lines attached to side supports in order to maintain the structure.

In many fabric structures, it is desirable to reduce or eliminate the center support means and guide lines needed to maintain a fabric at the proper tension and to minimize the overall support frame. Special ventilation systems to support the fabric are often required in such situations. In other cases, a complex frame is needed to support the fabric structure.

In U.S. Pat. No. 3,724,473, to Moss, a tent structure with arched supports is disclosed. The tent functions both as a portable shelter and as a parachute for deployment from an airplane. The shelter includes an extended center piece to achieve the desired tension in the side segments.

U.S. Pat. No. 4,644,706 Stafford et al. teaches a building structure with a transversely tensioned fabric covering. A plurality of arches supported in spaced, vertical positions. A winch is used to tension the corresponding fabric panels.

U.S. Pat. No. 4,880,024 to Brell shows a self supporting tent structure designed primarily for protecting small aircraft. The tent structure includes a special tensioning device to obtain the desired tension on the roof of the tent.

A panelized fabric covered structure is disclosed in U.S. Pat. No. 4,886,084 to Lawrence et al. The structure includes curved corner poles and arch support members.

U.S. Pat. No. 4,945,936 shows an umbrella type tent with a collapsible frame. An upper and lower clevis is used to provide a flexible upper section which can conform to the dome of the sheet material forming the tent cover.

A unique apex member is provided for the tent structure in U.S. Pat. No. 4,966,178 to Eichorn. The apex member is secured to each of the tent poles and includes a tensioning member which is moved to a tension position for providing the necessary tension to the tent structure.

SUMMARY OF THE INVENTION

The present invention relates to a portable structure provided with curved corner poles and a fabric membrane with specially anchored fabric arches to provide low cost shelter that is convenient to set up, tear down, and transport. Because no center supports or tension guide lines are needed, the structure of the present invention provides efficient space utilization.

In accordance with the present invention, there is provided a lightweight fabric structure having a plurality of curved corned poles with fabric arches extending between the corner poles, and more particularly, to a pavilion type tent structure having fabric arches to define the periphery of the structure with a flexible fabric membrane held in tension by the corner poles and center hub.

The fabric structure of the present invention includes a base member positioned at each of the corners of the structure. Each base includes a mounting post for receiving a corner post, and a means for securing the fabric corners to the base.

The corner poles are rectangular or square in cross section, and are pre-formed in a curved position. The base end of the corner pole slips over the mounting post in the base. The top end of the corner post is secured to the hub.

The corner poles are placed in an upright position and the center of the fabric is secured to a center rod extending from the hub. The flexible fabric membrane is formed from individual pieces of fabric fitted for each of the arches. The fabric includes a full length corner seam at each corner extending from the top of the center rod to the base. The corner seam of the fabric slidingly engages, but is not secured to the corner pole.

The bottom of the corner seam is connected to the base at the narrow corner of the fabric segments. An arch is formed in the fabric between each of the adjacent corner poles. A special fabric or webbing may be added along the periphery of the main fabric to improve the tension capabilities of the structure. A tension cable is sewn into the fabric along the peripheral edges which form the arches.

After the corner poles are erected and the corners of the fabric are secured to the base, the poles are raised to a new position on the mounting post, which tightens the fabric and creates the desired tension along the arches to provide a wrinkle-free tent structure. The proper tension is achieved without a center pole or any tension guide lines.

The pavilion structure of the present invention can be erected in a simple four-corner configuration. The structure may also be formed connecting a number of structures in series to form a single, larger structure.

An object of the present invention is provide a low cost and easy to assemble shade structure which can be utilized as an outdoor pavilion, pool cover, temporary housing, storage structure, or other similar application. The segmented arches and membrane are designed for easy transport, assembly, and disassembly.

An additional object of the present invention is to provide a fabric structure with no center support means and with no tension guide lines. Such a structure is preferred from a user standpoint because of the increased flexibility and space available when support means and tension guide lines are eliminated. The internal space is also optimized by the use of shape of the curved corner poles and the additional internal space created by the center rod in the hub.

A further object of the present invention is to provide an improved arch and tension support for the fabric structure. The arches, base, corner poles and hub are capable of creating and maintaining the necessary tension to support the fabric structure. The center rod improves the tension transfer capabilities of the corner poles.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
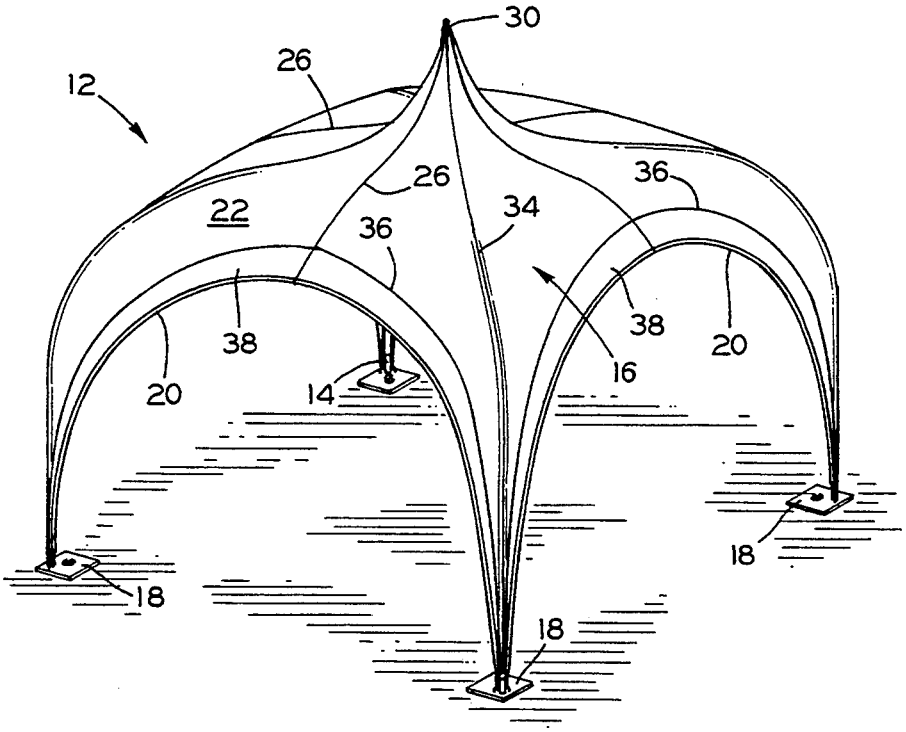
FIG. 1 is a perspective view of a fabric structure according to the present invention comprising four corner poles and four arches.

Referring now to the drawings, there is shown in FIG. 1 a fabric structure 12 formed by a plurality of corner poles 14 and a fabric membrane 16 mounted over the corner poles 14.

In the four arch structure shown in FIG. 1, the corner poles 14 are secured to base plates 18 located at the corners of the structure 12. The corner poles 14 and arches 20 along the periphery of the fabric membrane 16 define the periphery of the structure 12.

Access to the interior portion of the structure 12 is permitted through any of the arches 20. The arches 20 may be kept open, without any side covering, for a pavilion type structure. Fabric walls (not shown) may also be affixed to the arches 20 to provide privacy or protection from the environment. The fabric walls may include doors, windows, and other customary dwelling features.

Figure 2:
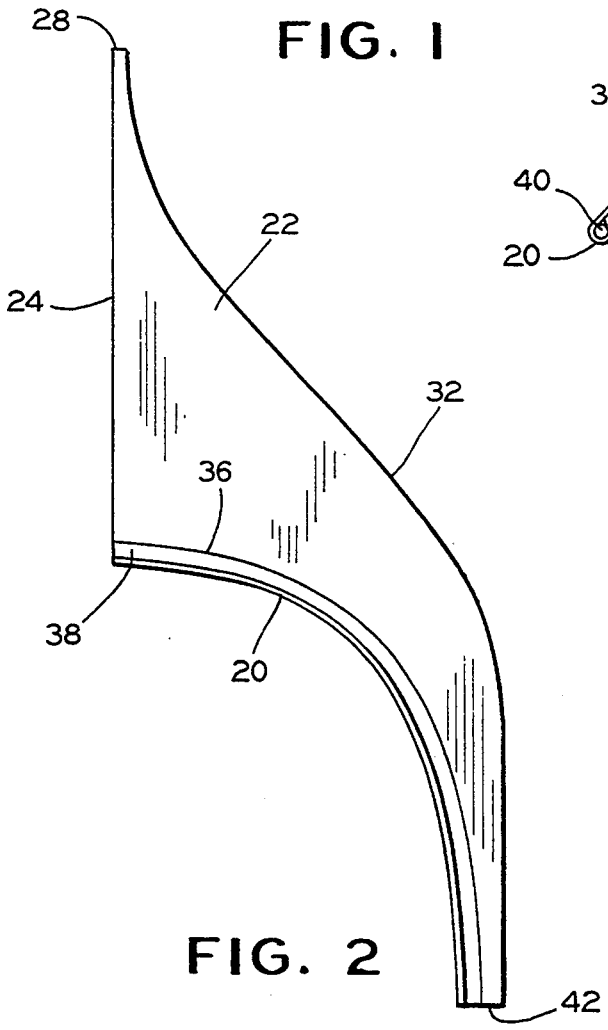
FIG. 2 is the preferred pattern of the fabric provided for the structure shown in FIG. 1.

The membrane 16 is made from canvas or other suitable fabric. A pattern for forming the membrane 16 is shown in FIG. 2. Each side of the membrane 16 is formed by two mirror-image pieces of the fabric segment 22. The two mirror-image pieces of fabric segment 22 are sewn together along straight edge 24 to form a seam 26 along the upper ridges of the structure 12.

The top edges 28 of the fabric segments 22 are sewn together to form a center crown aperture 30 with a grommet (not shown) at the center of the fabric membrane 16. The curved side edge 32 is sewn to the similar side edge 32 of the adjacent fabric segment 22 to form the corner seam 34.

The curved edge 36 of the fabric segment 22 has a webbing strip material 38 sewn to the edge 36. The webbing material 38 is needed to provide the stretching capabilities to place the arch 20 in tension. The webbing material 38 may be made from a variety of materials, such as 200 denier nylon or 20 ounce vinyl coated dacron.

Figure 3:
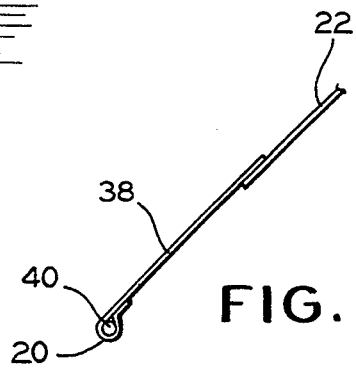
FIG. 3 is a cross sectional view of the fabric structure at the peripheral edge of the fabric to show the main fabric, the webbing material, and the arch cable sen into the webbing material.

The outer edge of the webbing includes a plastic coated cable 40 or other similar wire sewn in the fabric to form the outer edge of the arch 20. FIG. 3 shows the webbing material 38 sewn to the fabric segment: 22 along one edge and the cable 40 sewn into the other edge.

Figure 4:
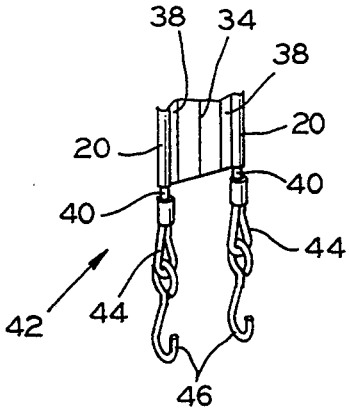
FIG. 4 shows the bottom of a corner seam of the fabric structure and the hooks connected to the arch cables to secure the fabric structure to the base.

The bottom edge 42 of the segment 22 for attachment to the base 18 is shown in FIG. 4 after the webbing material 38 of two adjacent segments 22 have been sewn together. The ends 44 of the,cable 40 are looped to secure a hook 46 for securing the membrane 16 to the base 18.

The corner poles 14 (FIG. 5) are made from a strong, light-weight material, such as aluminum. The poles 14 are hollow with a square or rectangular cross section. The poles 14 are bent to the desired shape at the time of formation.

The rounded segment 48 of corner pole 14 is important to maintaining the proper tension on the membrane 16. An extended vertical segment 50 is needed to provide the desired internal room within the structure 12. If the curve segment 48 is too sharp or too flat, then the tension force use to tighten the fabric membrane 16 is not properly transferred about the segment 48, which cause sagging or wrinkles in the fabric membrane 16. The radius of the curved segment 48, as shown in FIG. 5 achieves the proper transfer of the tension forces.

The rectangular cross section of the pole 14 is also an important feature. Round poles have a tendency to rotate once the structure 12 is assembled. If the corner seam 34 is not maintained in engagement with the corner pole 14 because of rotation, then an uneven tension in the membrane could occur, which may overstretch part of the material and allow wrinkles in the adjacent material on the other side of the corner pole 14. The pole 14 of the present invention does not rotate when mounted on the base 18.

The outer surface 52 of the corner poles 14 provides an appropriate surface for engaging the corner seams when the poles 14 are raised on the base 18 as hereinafter described. The fabric membrane 16 is not secured to the pole 14, but corner seam 34 engages a significant segment of the pole 14. The flat surface 52 permits the corner seam 34 to slide longitudinally along the surface 52 to achieve the desired increase in tension of the material 16, while at the same time minimizing any rotational or transverse movement of the corner seam 34 of the fabric 16, which wrinkles or overstretches the material. The seam 34 in the present invention remains on the flat outer surface 52, which provides a well maintained corner with proper transfer of the tension.

Figure 5:
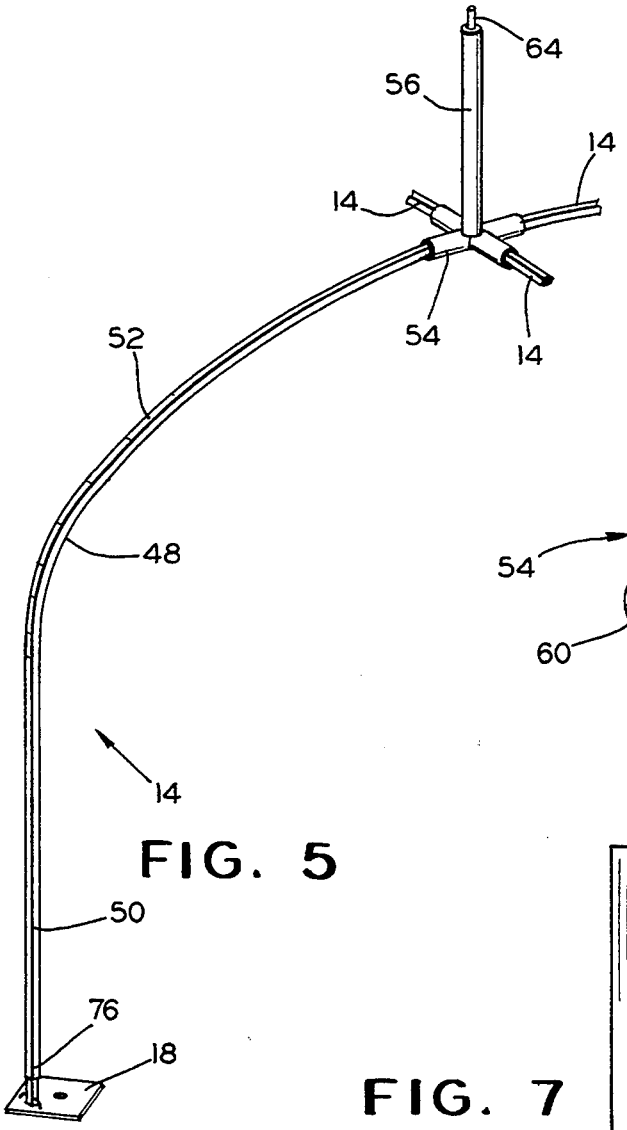
FIG. 5 is a perspective view of one of the corner poles, the hub and the center rod used to support the fabric structure without the fabric structure.
Figure 6:
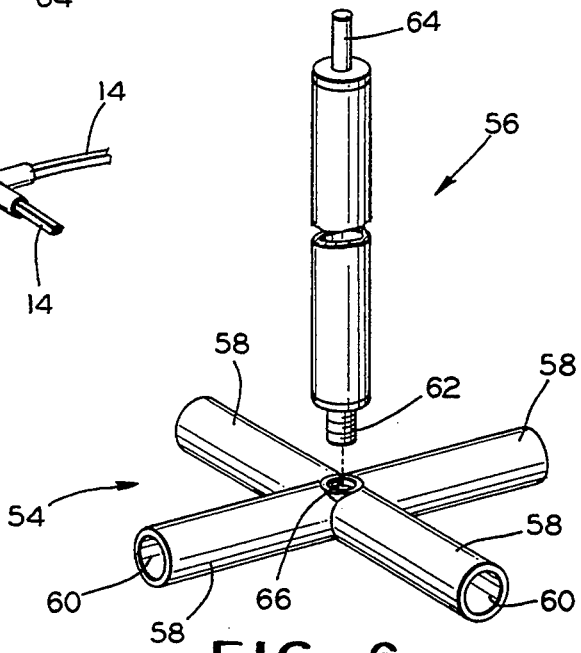
FIG. 6 is a perspective view of the hub and center rod.
Figure 7:
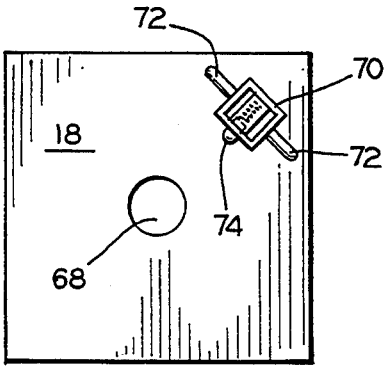
FIG. 7 is a top plan view of the base plate with mounting post for securing the corner poles and fabric structure of the present invention.

The hub 54 and center rod 56 of the present invention are shown in FIGS. 5 and 6. The hub 54 has individual receptacles 58 with an opening 60 for receiving the top end of the poles 14. The receptacles 58 may be provided with either a rectangular or circular opening 60. The circular opening permits the corner pole, if disengaged from the base 18, to be rotated within the receptacle 58. The rotational capability is beneficial the formation of the structure 12. Once the poles 14 are placed on the base 18, the poles 14 are no longer capable of rotation, which is preferred configuration for placing the structure 12 in final tension.

The center rod 56 includes a threaded end 62 and a straight end 64. The threaded end 64 is secured in threaded center opening 66 of the hub 54. The center opening 30 in the fabric membrane 16 is placed over the straight end 64 of the center rod 56.

The base plate 18 is provided with an aperture 68 and a mounting post 70. The aperture 68 in base plate 18 provides a means for securing the base plate 18 to a surface. The aperture 68 may receive an eye bolt 52 extending into the ground, blacktop, or other surface. Stakes or other means for securing the base 18 may also be utilized.

The base plate 18 includes a rectangular mounting post 70 extending vertically from the plate 18. The mounting post 70 is sized to fit in the bottom end 76 of the corner post 14. Once the corner post 14 is mounted on the mounting post 70, the rotational movement of the post 14 is restricted.

Two angle irons 72 are secured to the base 18 and mounting post 70. The angle irons 72 are used to secure hooks 46 at the bottom end 42 of the fabric membrane 16 at the corner seam 34.

The mounting post 70 includes a spring locking mechanism to lock the corner pole 14 in the desired position. A mounting bolt or other similar device for locking the pole 14 in place could be substituted for the spring locking device 74. The bottom end 76 of the pole 14 includes five or more holes 78 for receiving the locking mechanism 74.

Figure 8:
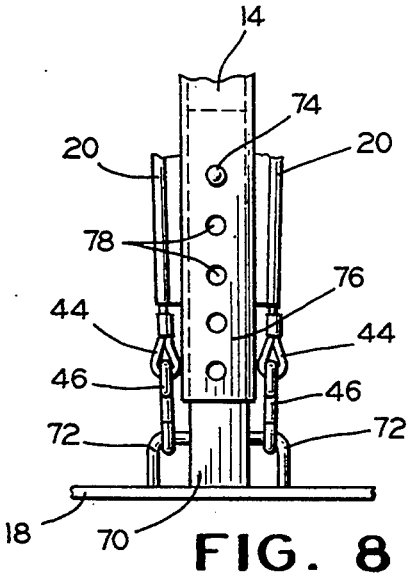
FIG. 8 is a side view of the base plate with mounting post for securing the corner poles and fabric structure of the present invention, including the arch cables of the fabric structure and a corner pole secured to the base prior to tensioning the structure.
Figure 9:
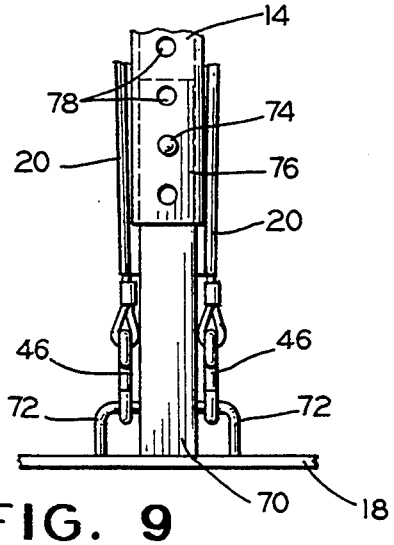
FIG. 9 is a top plan view of the base plate with mounting post shown in FIG. 8 after the corner pole has been raised on the mounting post to achieve the desired tension in the fabric.

The fabric 16 with hooks 46, and the corner posts 14, with bottom end 76, are independently connected to the base 18. FIG. 8 shows the position of the bottom end of the pole 14 during the initial set up of the structure 12. Although there is some tension in the fabric membrane 16, there may still be a significant number of wrinkles or sagging of the membrane. After all of the poles 14 are upright on the base 18 and the fabric membrane 16 has been secured by hooks 46, then the pole 14 may be extended to a new locking position as shown in FIG. 9. The pole 14 can typically be repositioned manually by lifting the pole 14. As the pole 14 is raised, the corner seam 14 slides along the outer surface 52 of the pole 14 and increasing tension is properly transferred throughout the membrane 16. The increased tension caused by raising the pole 14 on the mounting post 70 eliminates the problems with a wrinkled or sagging structure 12.

The center rod 56 also facilitates the desired tension force transfer and prevents the middle of the fabric membrane 16 from sagging. The raised construction causes water to drain properly from the top of the structure 12.

In the present invention, no guide lines or center support structures are needed to maintain the structure 12. The use of the corner poles 14 with the special means for securing the membrane 16, maintains sufficient tension on the membrane 16 to ensure the integrity of the structure 12. The fabric structure 12 provides efficient space utilization, both internally and externally, when compared with other similar structures.

In erecting the structure 12, the membrane 16 is laid out in the area to be covered by the structure 12. The base plates 18 are mounted at the corners of the structure 12 at the specific distance for which the structure 12 is designed. Two poles 14 on opposite sides of the structure are secured to the hub 54 with center rod 56. The aperture 30 is secured to the center rod 56 and the first two poles 14 with the hub 54 and membrane 16 are raised to an upright position. Once the initial two poles 14 are upright, the remaining poles are placed upright and inserted into the appropriate opening 60 on the hub 54, and then onto the mounting post 70 on the base plate 18. At that point, the poles 14 stay upright.

Once all of the poles 14 are upright, the fabric membrane, which is now being support by the poles 14, is stretched to permit the hooks 46 to be secured to the angle irons 72 on the base 18. Once the hooks 46 are secured, the membrane 16 is secure, but not in full tension. The poles 14 are raised on the mounting post 70 to a higher position, which further tightens the membrane 16 and eliminates wrinkles.

When the poles 14 are raised, the center rod 56 is moved vertically, which transfers tension along seam 36 to have the edges 20 in the proper tension to create the arches in structure 12.

In addition to the four arch configuration discussed above, the structure 12 may be built in a similar manner for three or more arches.

In accordance with the provisions of the patent statutes, the present invention has been described in what is considered to represent its preferred embodiment. However, it should be noted that the invention can be practiced otherwise than a specifically illustrated and described without departing from its spirit or scope.

What is claimed is:

1. A pavilion-type fabric structure adapted to be erected on a support surface to provide shelter, said fabric structure comprising:

a) a plurality of curved corner poles, said corner poles being rectangular in cross section and having a base end, a top end, an outer surface, said corner poles positioned in space apart relationship on a support surface;

b) a fabric membrane provided with a plurality of corner seams, said fabric membrane positioned on said curved corner poles such that a segment of each corner seam slidably engages a corresponding segment of the outer surface of a corner pole, a peripheral edge of said fabric membrane forming a plurality of arches such that an arch extends between each adjacent set of corner poles;

c) a plurality of base plates positioned on the support surface, each base plate including a mounting means receiving and adjustably securing the base end of a corner pole to said base, and a separate tensioning means securing said fabric membrane to said base;

d) a hub having a plurality of receptacles receiving and securing the top end of each of said plurality of corner poles to said hub; and e) a center rod secured to said hub and extending vertically therefrom, said center rod including a top end secured to said fabric membrane whereby said fabric membrane, which is secure to said base and said center rod, may be placed in the desired tension by further extending said plurality of corner poles from said base plates.

2. The fabric structure defined in claim 1 wherein the peripheral edge of said fabric membrane is formed from a webbing material.

3. The fabric structure defined in claim 2 wherein the peripheral edge of said fabric membrane includes a wire means secured in the webbing material to facilitate connection of said fabric membrane to said base plate.

4. The fabric structure defined in claim 3 wherein said wire means is a plastic coated wire.

5. The fabric structure defined in claim 3 wherein the tensioning means on each of said base plates includes a means securing the wire means to said base plate.

6. The fabric structure defined in claim 1 wherein the mounting means on each of said base plates includes a mounting post extending vertically from said base plate.

7. The fabric'structure defined in claim 6 wherein said mounting poles are hollow, and the mounting post on said base plate includes a means receiving and selectively securing said corner pole to said base whereby the height of said corner pole may be adjusted.

8. The fabric structure defined in claim 6 wherein the mounting post on said base plate is rectangular in cross section such that the rotational movement of said corner pole is restricted.

9. The fabric structure defined in claim 1 wherein said fabric membrane includes a plurality of fabric segments sewn together at the corner seams or at a center seam extending from an apex of the arch to the top end of said center rod.

10. The fabric structure defined in claim 1 wherein said curved corner poles include a rounded corner to facilitate the tension distribution to the arches formed in said fabric membrane.

* * * * *